US007084721B2

(12) United States Patent
Enokihara

(10) Patent No.: US 7,084,721 B2
(45) Date of Patent: Aug. 1, 2006

(54) RF CIRCUIT COMPONENT

(75) Inventor: Akira Enokihara, Nara (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 72 days.

(21) Appl. No.: 10/518,619

(22) PCT Filed: Mar. 2, 2004

(86) PCT No.: PCT/JP2004/002586

§ 371 (c)(1),
(2), (4) Date: Dec. 21, 2004

(87) PCT Pub. No.: WO2004/088785

PCT Pub. Date: Oct. 14, 2004

(65) Prior Publication Data

US 2006/0006957 A1 Jan. 12, 2006

(30) Foreign Application Priority Data

Mar. 28, 2003 (JP) ..... 2003-091150

(51) Int. Cl.
*H01P 1/203* (2006.01)

(52) U.S. Cl. ..... 333/204; 333/219

(58) Field of Classification Search ..... 333/204, 333/205, 219, 202

See application file for complete search history.

(56) References Cited

U.S. PATENT DOCUMENTS 5,172,084 A 12/1992 Fiedziuszko et al.
5,896,073 A 4/1999 Miyazaki et al.
6,157,274 A * 12/2000 Tada et al. ..... 333/204
6,239,674 B1 5/2001 Enokihara et al.
6,252,475 B1 6/2001 Enokihara et al.
6,646,524 B1 11/2003 Okada et al.
2002/0004462 A1 1/2002 Enokihara et al.

FOREIGN PATENT DOCUMENTS

JP 57-155802 A 9/1982
JP 06-204702 A 7/1994

OTHER PUBLICATIONS

Watkins, J., "Circular Resonant Structures In Microstrip", *Electronic Letters*, vol. 5, No. 21, pp. 524-525, (1969).
Enokihara et al., "High-$T_c$ Superconducting Planar Filter For Power Handling Capability", *JEICE Trans. Electron.*, vol. E79-C, No. 9, pp. 1228-1232, (1996).

* cited by examiner

*Primary Examiner*—Stephen E. Jones
(74) *Attorney, Agent, or Firm*—Akin Gump Strauss Hauer & Feld, LLP

(57) ABSTRACT

An RF circuit component according to the present invention includes a substrate with a principal surface and a plurality of resonators, including a first resonator, a second resonator and a third resonator, which are arranged on the principal surface of the substrate so as to be coupled in series together. Each of the first, second and third resonators is made of a conductor supported on the substrate. The resonant modes of each of the first, second and third resonators include two fundamental resonant modes that oscillate perpendicularly to each other within a plane that is defined parallel to the principal surface of the substrate. The second resonator is arranged between the first and third resonators, and the oscillation direction of one of the fundamental resonant modes of the second resonator defines an angle greater than 0 degrees but smaller than 90 degrees with respect to that of its associated fundamental resonant mode of the first resonator and/or the third resonator.

8 Claims, 5 Drawing Sheets

(a)

RF CIRCUIT COMPONENT

CROSS-REFERENCE TO RELATED APPLICATIONS

This application is a section 371 of International Application No. PCT/JP2004/002586, filed Mar. 2, 2004, the disclosure of which is incorporated herein by reference.

TECHNICAL FIELD

The present invention relates to a radio frequency (RF) circuit component with multiple resonators. Such an RF circuit component can be used effectively as a filter or branch device for an RF signal processor in a communications system.

BACKGROUND ART

An RF circuit component, including a resonator as its basic element, is an essential component of an RF communications system. For example, a mobile communications system needs an RF circuit component functioning as a narrow band filter to utilize its frequency range effectively. Also, in the base station of a mobile communications system and a communication satellite, the development of a narrow-band, low-loss and small-sized filter that can withstand huge power has been long awaited.

Also, milliwave or quasi milliwave band wireless communications systems, developed remarkably these days, have used waveguide filters but desperately need such small-sized and low-loss filters, too.

Some of currently used RF circuit components such as resonator filters adopt a transmission line structure. An RF circuit component with a transmission line structure is small-sized and applicable up to radio frequencies falling within the microwave and milliwave ranges. Also, such an RF circuit component has a two-dimensional structure defined on a substrate, can be easily combined with other circuits and components, and is used extensively today.

As a typical example of a planar transmission line structure, an RF circuit component, which makes a disklike resonator exhibit a filtering characteristic by coupling a dipole mode thereto with protrusions provided for portions of its outer periphery, was reported in U.S. Pat. No. 5,172,084, for example.

The present inventor invented a multi-stage filter such as that shown in FIG. 7 and disclosed it in Japanese Laid-Open Patent Application Publication No. 2000-77905. This filter includes three elliptical conductors 2a, 2b and 2c, which are arranged in line, and two coupling terminals 6a and 6b coupled to the elliptical conductor 2a.

This filter can create an attenuation pole in a curve representing a filter characteristic. However, it is still difficult even for this filter to create the attenuation pole at a desired frequency and with a desired quantity of attenuation. This is because the frequency and quantity of attenuation of the attenuation pole need to be adjusted according to the specific combination of the degree of coupling between the elliptical conductors 2a, 2b and 2c, the filter characteristic and the quantity of filter loss.

Japanese Laid-Open Patent Application Publications No. 8-46413 and No. 10-308611 disclose RF circuit components including a disklike or elliptical conductor as its resonator. However, it is difficult for each of these RF circuit components to control the transmission characteristic with high precision, which is a common problem for them.

In order to overcome the problems described above, an object of the present invention is to provide an RF circuit component that achieves a desired frequency and a desired quantity of attenuation with a simple configuration.

DISCLOSURE OF INVENTION

An RF circuit component according to the present invention includes a substrate with a principal surface and a plurality of resonators, including a first resonator, a second resonator and a third resonator, which are arranged on the principal surface of the substrate so as to be coupled in series together. Each of the first, second and third resonators is made of a conductor supported on the substrate. The resonant modes of each of the first, second and third resonators include two fundamental resonant modes that oscillate perpendicularly to each other within a plane that is defined parallel to the principal surface of the substrate. The second resonator is arranged between the first and third resonators, and the oscillation direction of one of the fundamental resonant modes of the second resonator defines an angle greater than 0 degrees but smaller than 90 degrees with respect to that of its associated fundamental resonant mode of the first resonator and/or the third resonator.

In one preferred embodiment, the second resonator is made of a conductor, which has an elliptical cross section when taken parallel to the principal surface, and the oscillation directions of the two fundamental resonant modes of the second resonator are respectively parallel to the major axis and minor axis of the elliptical cross section.

In another preferred embodiment, each of the first and third resonators is made of a conductor, which has an elliptical cross section when taken parallel to the principal surface, and the oscillation directions of the two fundamental resonant modes in each of the first and third resonators are respectively parallel to the major axis and minor axis of the elliptical cross section.

In another preferred embodiment, the RF circuit component further includes an input coupling terminal for inputting an RF signal to one of the resonators and an output coupling terminal for outputting the RF signal from another one of the resonators.

In another preferred embodiment, each of the two resonators coupled to the input and output coupling terminals, respectively, is made of a conductor, which has the shape of an ellipse when taken parallel to the principal surface. The input coupling terminal is coupled to the resonator at a point away from an intersection between the major or minor axis of the ellipse and the ellipse itself, and the output coupling terminal is coupled to the resonator at a point away from an intersection between the major or minor axis of the ellipse and the ellipse itself.

In another preferred embodiment, the first resonator and the input coupling terminal are directly connected together and the third resonator and the output coupling terminal are directly connected together.

In another preferred embodiment, the RF circuit component further includes a metallic housing that is arranged so as to surround the substrate, and a screw is provided so as to go through the metallic housing.

In another preferred embodiment, the conductor is made of a superconductor material.

BRIEF DESCRIPTION OF DRAWINGS

FIG. 1(*b*) is a cross-sectional view thereof as viewed on the plane I–I'; FIG. 1(*c*) is a plan view illustrating the conductor pattern of the first resonator 21 and the input coupling terminal 31 in detail; and FIG. 1(*d*) is a plan view illustrating the second resonator 22 in detail.

BEST MODE FOR CARRYING OUT THE INVENTION

EMBODIMENT 1

Hereinafter, an RF circuit component according to a first preferred embodiment of the present invention will be described with reference to FIGS. 1(*a*) through 1(*d*).

Figure 1:
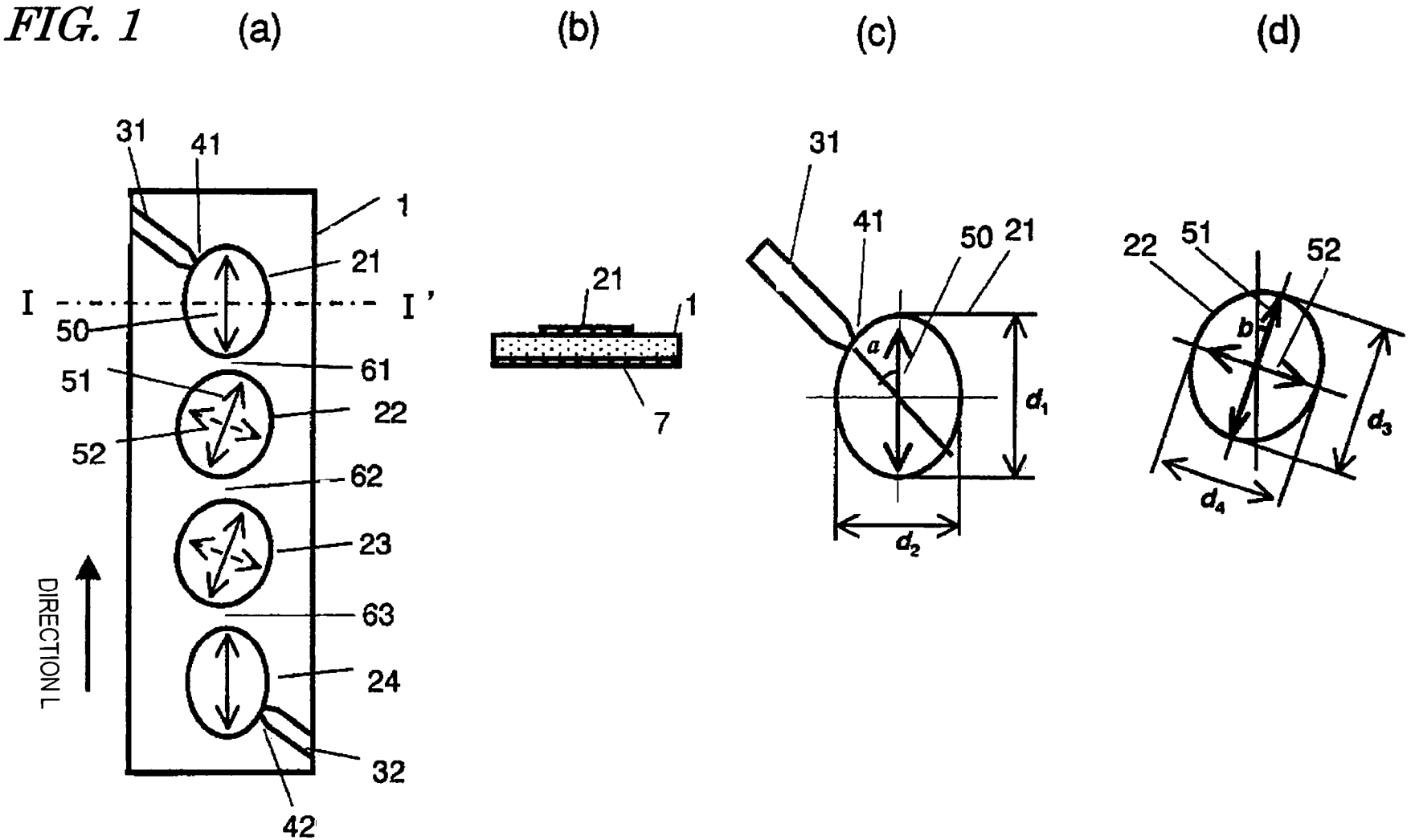
FIG. 1(*a*) is a plan view illustrating an RF circuit component according to a first preferred embodiment of the present invention.

As shown in FIGS. 1(*a*) and 1(*b*), the RF circuit component of this preferred embodiment includes a, substrate 1 with a principal surface and a first resonator 21, a second resonator 22, a third resonator 23 and a fourth resonator 24, which are arranged on the principal surface of the substrate 1 so as to be coupled in series together.

Each of these resonators 21, 22, 23 and 24 is an elliptical conductor pattern provided on the principal surface of the substrate 1. The resonant modes of each of these resonators 21, 22, 23 and 24 include two fundamental resonant modes (dipole modes), which oscillate perpendicularly to each other within a plane that is defined parallel to the principal surface of the substrate 1. In a circular or elliptical planar resonator, two of the fundamental resonant modes thereof, which have the lowest resonant frequency, will be referred to herein as "dipole modes". The resonant modes of a circular planar resonator are sometimes identified in association with an electric field distribution in a propagation mode of a cylindrical waveguide (see J. Watkins, "Circular Resonant Structures in Microstrip", Electron. Lett., 5, 21, p. 524 (1969)). According to such an association, the "dipole modes" in this specification may be called "$TM_{11}$ modes".

In the resonators 21, 22, 23 and 24 shown in FIG. 1, the directions of the dipole modes are the same as those of the major and minor axes of each ellipse. That is to say, in FIG. 1(*a*), the directions of the bidirectional arrows 51 and 52 point the directions of the two independent dipole modes of the second resonator 22. Also, the arrow 50 indicates one of the two dipole modes of the first resonator 21.

In a disklike resonator with a completely round shape, the two independent dipole modes have degeneracy and therefore have the same resonant frequency. In an elliptical resonator on the other hand, the two dipole modes no longer have the degeneracy and have two mutually different resonant frequencies that are defined by the major and minor axes of the ellipse, respectively. Accordingly, the elliptical resonator can utilize the two modes separately from each other, thereby functioning as two resonators with different resonant frequencies by itself.

In this preferred embodiment, the oscillation direction of the fundamental resonant mode of the first resonator 21 (as indicated by the arrow 50) is parallel to that of the fundamental resonant mode of the fourth resonator 24. However, the oscillation direction of one of the fundamental resonant modes of the second resonator 22 (as indicated by the arrow 51) defines an angle greater than 0 degrees but smaller than 90 degrees with respect to that of the fundamental resonant mode of the first resonator 21 (as indicated by the arrow 50). On the other hand, the oscillation direction of one of the fundamental resonant modes of the third resonator 23 is parallel to that of its associated fundamental resonant mode of the second resonator 22 (as indicated by the arrow 51) and defines an angle greater than 0 degrees but smaller than 90 degrees with respect to that of the fundamental resonant mode of the fourth resonator 24.

In this preferred embodiment, the structure of the resonators 21 through 24 is defined by providing a conductor pattern, made of a metal film (with a thickness of 0.1 μm to 10 μm, for example), on the principal surface of the substrate 1 as shown in FIG. 1(*b*). A ground plane 7 (with a thickness of 0.1 μm to 10 μm, for example), also made of a metal film, is provided on the back surface of the substrate 1.

The substrate 1 is made of a dielectric material such as a ceramic and has dimensions of 15 mm×4 mm×1.5 mm, for example. In a preferred embodiment, the metal film is deposited on the principal surface of the substrate 1 by some thin film deposition technique such as vacuum evaporation. The shape and location of each conductor pattern may be arbitrarily defined by performing an etching process using a mask or a liftoff process.

The elliptical conductor patterns, functioning as the respective resonators 21, 22, 23 and 24, are arranged in series to each other with gaps 61, 62 and 63 provided between them, thereby forming a planar microwave transmission line.

To the first resonator 21, located at one end of the serial arrangement of the resonators 21, 22, 23 and 24, an input coupling terminal 31 is connected at an input coupling point 41. On the other hand, to the fourth resonator 24, located at the other end of the serial arrangement of the resonators 21, 22, 23 and 24, an output coupling terminal 32 is connected at an output coupling point 42. In this preferred embodiment, an RF signal (with a frequency of 15 GHz to 20 GHz, for example) is input through the input coupling terminal 31 and a filtered RF signal component is output through the output coupling terminal 32.

As shown in FIG. 1(*c*), the input coupling terminal 31 is connected to a point on the circumference of the second quadrant of the ellipse (i.e., the upper left portion of the ellipse shown in FIG. 1(*c*)) so as to tilt a degrees from the major axis of the ellipse of the first resonator 21 (i.e., an axis parallel to the arrow 50). On the other hand, the output coupling terminal 32 is connected to a point on the circumference of the fourth quadrant of the ellipse (i.e., the lower right portion of the ellipse shown in FIG. 1(*c*)) so as to tilt a degrees from the major axis of the ellipse of the fourth resonator 24. That is to say, both the input and output coupling terminals 31 and 32 are coupled to the resonators 21 and 24 at respective points that are away from the intersections between the outer circumference of the ellipse and the major or minor axis of the resonator 21 or 24.

The degree of coupling between the input coupling terminal 31 and the resonator 21 and between the output coupling terminal 32 and the resonator 24 is the highest when the angle a is equal to zero degrees. However, when this angle a is equal to ninety degrees, the degree of coupling becomes zero. Accordingly, by adjusting the angle a within the range of zero degrees to less than ninety degrees (i.e., $0° \leqq a < 90°$), a desired degree of coupling is achieved. In this manner, the degree of coupling can be controlled in a wide range by adjusting the angle a and therefore the circuit can be designed with much more freedom.

The RF signal that has been input through the input coupling terminal 31 to the first resonator 21 produces a resonance state in the first resonator 21. If the angle a is equal to zero degrees, this resonance state is defined by the dipole mode that oscillates (or is polarized) in the major-axis direction of the ellipse. On the other hand, if the angle a satisfies $0° < a < 90°$, that resonance state is defined by the superposition of the independent modes. More specifically, the resonance state can be represented by the superposition of the dipole mode polarized in the major-axis direction and the dipole mode polarized in the minor-axis direction. In the example illustrated in FIG. 1(*c*), the closer to zero degrees the angle a, the more dominating the dipole mode component polarized in the major-axis direction. Meanwhile, the closer to ninety degrees the angle a, the more dominating the dipole mode component polarized in the minor-axis direction.

In the layout illustrated in FIG. 1(*a*), the ellipse major-axis directions of the respective resonators 21, 22, 23 and 24 with the same shape are substantially parallel to the direction in which the resonators are arranged (i.e., the direction L). For that reason, the dipole mode, polarized in the major-axis direction in the first resonator 21, is sequentially coupled with, and propagated to, one of the following resonators 22, 23 and 24 after another.

As shown in FIG. 1(*c*), the ellipse of the first resonator 21 has a major-axis diameter $d_1$ and a minor-axis diameter $d_2$. On the other hand, the ellipse of the second resonator 22 has a major-axis diameter $d_3$ and a minor-axis diameter $d_4$ as shown in FIG. 1(*d*).

In the first resonator 21, the dipole mode polarized in the major-axis direction has a resonant frequency that depends on the major-axis diameter $d_1$. In the same way, the dipole mode polarized in the minor-axis direction has a resonant frequency that depends on the minor-axis diameter $d_2$. In this preferred embodiment, a filter that passes an RF signal, of which the center frequency is defined by the diameter $d_1$, is realized. For that purpose, the other resonators 22, 23 and 24 are designed so as to have their diameter in the elliptical major-axis direction match the diameter $d_1$.

In this manner, according to this preferred embodiment, only the dipole mode in the major-axis direction is used. Accordingly, the conductor patterns of the respective resonators 21, 22, 23 and 24 are defined to be elliptical, not completely round. In the following description, "1—(minor-axis length/major-axis length)" will be referred to herein as an "ellipticity". Thus, if the "ellipticity" is equal to zero, that shape is round. For that reason, the elliptical conductor of each resonator of this preferred embodiment has an ellipticity greater than zero. According to the present invention, the ellipticity needs to be at least 0.01%, more preferably 1% or more. Optionally, the ellipticity may be set to even 10% or more.

In this manner, the ellipticity is set greater than zero such that the resonant frequency of the dipole mode in the minor-axis direction falls out of the frequency range to be used by the circuit (i.e., the "transmission band" in this preferred embodiment). That is to say, $d_1$ is defined so as to produce resonance at a desired frequency as to the dipole mode in the major-axis direction, while $d_2$ is defined so as to produce resonance at a frequency, which does not affect the operation of the circuit, as to the dipole mode in the minor-axis direction. Accordingly, the "ellipticity" is defined appropriately depending on how much the difference between the frequency of the dipole mode in the major-axis direction, or the resonant frequency (i.e., the center frequency of the transmission band), and the frequency of the attenuation pole to be described later should be.

As for coupling between the resonators, the degree of coupling between the dipole modes of two adjacent resonators can be adjusted by defining an appropriate gap for the gap portion 61, 62 or 63 and the degree of coupling with the dipole mode in the major-axis direction of the resonators 21 and 24 at both ends can be adjusted by the angle a. Consequently, by appropriately setting the angle a, major-axis diameter $d_1$ and the gaps in the gap portions 61, 62 and 63, the RF circuit component with this structure operates as a four-stage resonator coupling filter.

In this preferred embodiment, the four resonators 21, 22, 23 and 24 are arranged in line in the direction L as described above. However, the major-axis direction of the second and third resonators 22 and 23 is defined so as to tilt by b degrees with respect to that of the first and fourth resonators 21 and 24, i.e., the direction L. In such an arrangement, the dipole mode in the major-axis direction of the first resonator 21 can also be coupled with the dipole mode 52 in the minor-axis direction of the second resonator 22 by adjusting the tilt angle b. In the same way, the dipole mode in the minor-axis direction of the third resonator 23 can also be barely coupled with the dipole modes in the major-axis directions of the other resonators 21, 22 and 24.

This angle b is formed by the polarization direction (i.e., oscillation direction) of the fundamental resonant mode of the RF component to be transmitted through two resonators to couple. This angle b is defined greater than 0 degrees and equal to or smaller than 45 degrees.

As a result of this mode coupling by the resonators, a signal having a frequency component corresponding to the resonant frequency of the dipole mode in the minor-axis direction is absorbed into the dipole mode in the minor-axis direction and an attenuation pole can be created at the frequency corresponding to the resonant frequency of the dipole mode in the minor-axis direction.

Hereinafter, a specific configuration according to this preferred embodiment will be described more fully.

In this preferred embodiment, a thin plate (with a thickness of 0.5 mm), made of a glass ceramic material (with a relative dielectric constant of 5.6 and an fQ value of 33,000) including an $Al_2O_3$—MgO—$Gd_2O_3$—$SiO_2$ based ceramic filler and $SiO_2$—$Al_2O_3$—$B_2O_3$—MgO—ZnO based glass, may be used as the substrate 1.

The elliptical patterns of the resonators were designed such that the resonators had a center frequency of GHz. More specifically, the major-axis diameter was set to around 3 mm, the minor-axis diameter was defined to be an appropriate ratio of 0.5 to 0.9 with respect to the major-axis diameter, and the input and output lines 3 had a line width of 0.8 mm. The conductor was made of a silver thin film with a thickness of 10 μm. The number and arrangement of the resonators were determined just as shown in FIG. 1(*a*). And the angles a and b were set to 20 degrees and 5 degrees, respectively.

Figure 2:
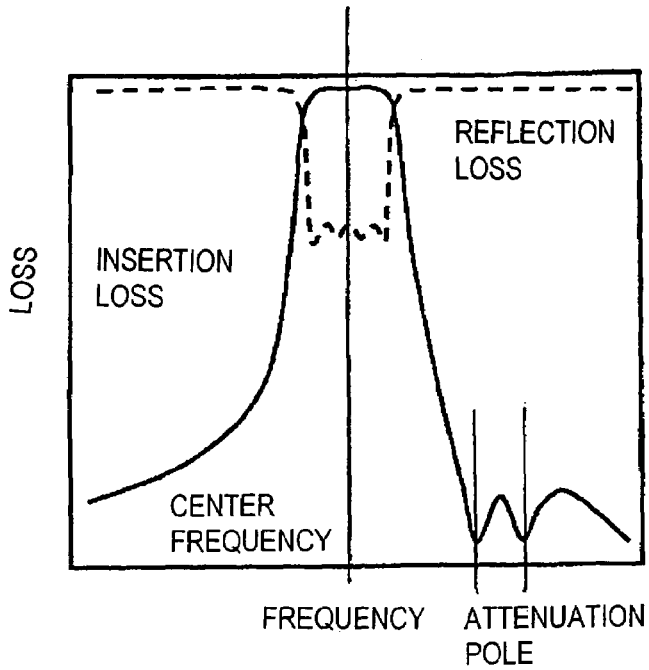
FIG. 2 is a graph showing frequency characteristics of the RF circuit component according to the preferred embodiment.

FIG. 2 shows a typical frequency characteristic (i.e., how the reflection loss and insertion loss change with the frequency) that an RF circuit component having the configuration described above would exhibit. As used herein, the "reflection loss" refers to the quantity of loss caused by the reflection of the signal that has been input through the input coupling terminal 31. On the other hand, the "insertion loss" refers to the quantity of loss caused in the signal after the signal was input through the input coupling terminal 31 and before the signal is output through the output coupling terminal 32.

As can be seen from FIG. 2, in the vicinity of the center frequency, the reflection loss is big but the insertion loss is small. However, as the frequency deviates from the center frequency, the reflection loss decreases but the insertion loss increases. That is to say, it can be seen that a high filtering effect is achieved in the vicinity of the center frequency.

As also shown in FIG. 2, two attenuation poles are formed at two frequencies corresponding to the resonant frequencies of the dipole modes in the minor-axis direction of the second and third resonators 22 and 23. There are two attenuation poles because the ellipse minor-axis length of the second resonator 22 is different from that of the third resonator 23. If the major-axis length of the second and third resonators 22 and 23 is 3 mm, for example, the minor-axis lengths of the second and third resonators 22 and 23 may be set to 2.9 mm and 2.8 mm, respectively. By adjusting the number of the resonators and the ellipse minor-axis lengths thereof, the number and locations (i.e., generation frequencies) of the attenuation poles can be defined arbitrarily.

To change the filter characteristic steeply by forming these attenuation poles, the ellipse major-axis direction of the second resonator 22 and/or the third resonator 23 needs to be rotated from that of the first resonator 22 and/or the fourth resonator 24. This is because by rotating the ellipse major axis in this manner, a resonant mode oscillating in the ellipse minor-axis direction is brought about.

According to this preferred embodiment, even though the same number of resonator stages are used, a steeper filter characteristic is realized due to the presence of those attenuation poles.

In the prior art, to form such attenuation poles, a skipped coupling arrangement was usually adopted to couple the resonators together. However, if such a skipped coupling arrangement were realized with the resonators for use in the present invention, then the dipole modes in the major-axis direction of the first and fourth resonators 21 and 24 should be barely coupled together directly. But such coupling is very hard to realize. What is worse, the frequencies to form the attenuation poles become very inaccurate. In contrast, according to the present invention, the attenuation poles can be formed with a simple structure. In addition, the frequencies to form the attenuation poles are determined by the minor-axis diameter $d_4$ of the second and third resonators 22 and 23. Accordingly, the attenuation pole frequencies can be defined with high accuracy.

Figure 3:
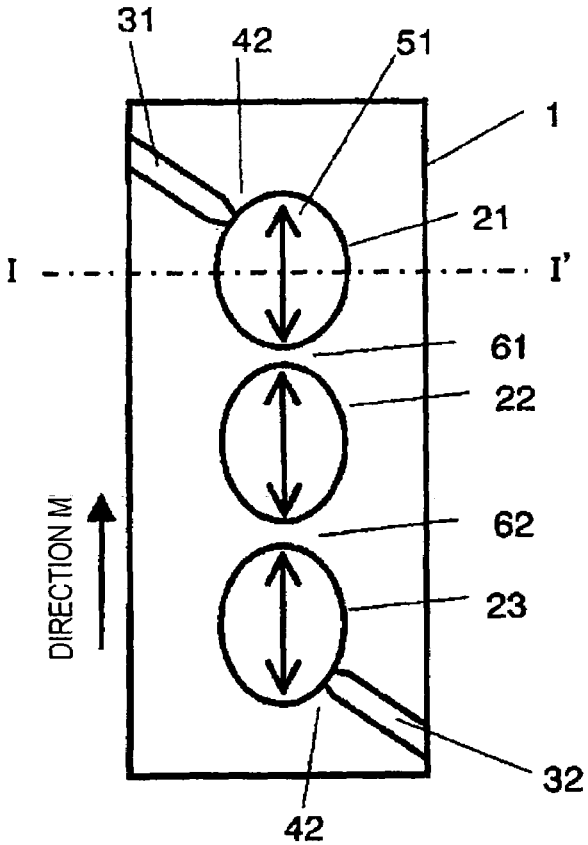
FIG. 3 is a plan view illustrating an RF circuit component according to a comparative example.
Figure 4:
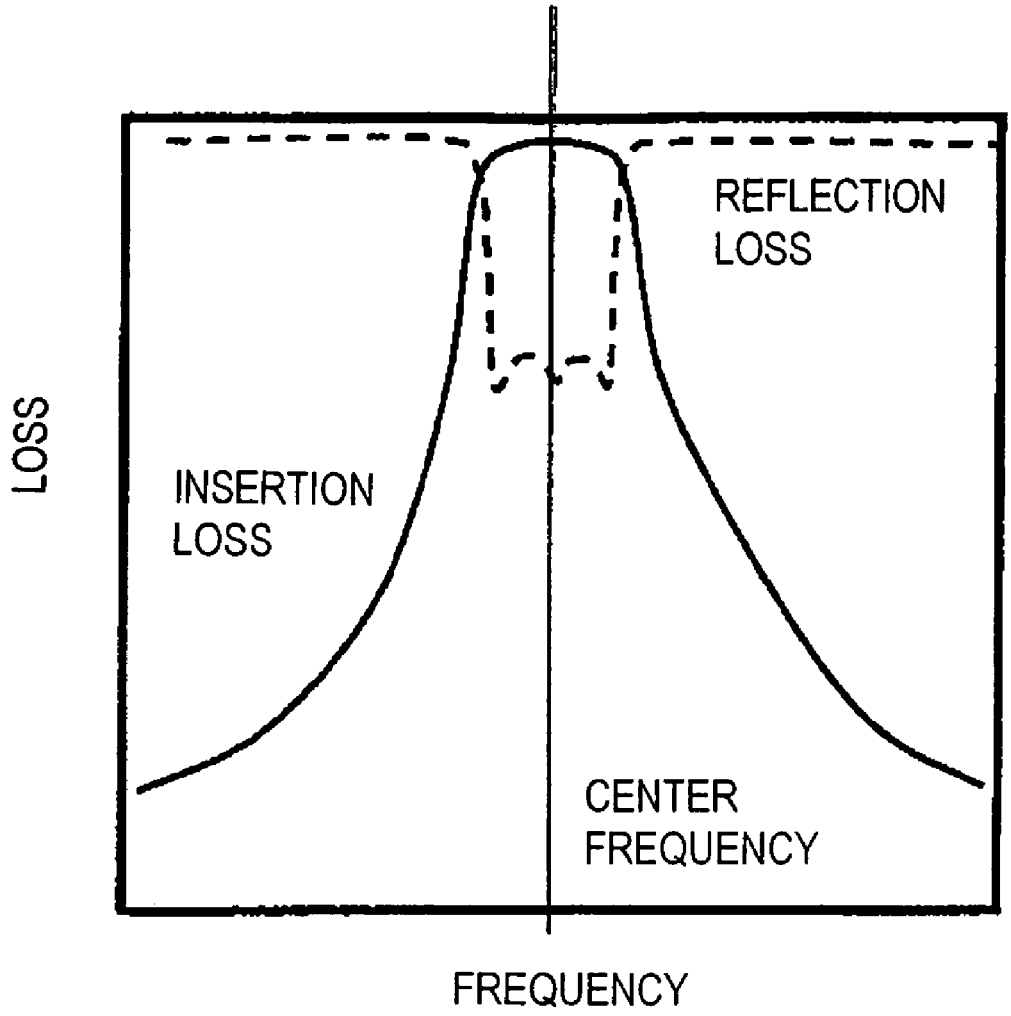
FIG. 4 is a graph showing frequency characteristics of the RF circuit component shown in FIG. 3.

An RF circuit component such as that shown in FIG. 3 was fabricated as a comparative example and its reflection loss and insertion loss characteristics were evaluated. FIG. 4 is a graph showing the results of that evaluation. Comparing the graphs shown in FIGS. 2 and 4 with each other, it can be seen that a filter characteristic with an even narrower pass band is realized by this preferred embodiment. The pass band becomes narrower in this manner because the curve representing the frequency dependence of the insertion loss is sharpened by the presence of the attenuation poles.

FIG. 1(*a*) shows a four-stage filter including the four resonators 21, 22, 23 and 24. However, according to the present invention, the number of resonator stages is not limited to four but may be two, five or more. Also, not all of the conductor patterns of the resonators 21, 22, 23 and 24 have to be elliptical, but the conductor pattern of at least one of the second and third resonators 22 and 23 needs to be elliptical. Furthermore, as long as the resonators have conductor patterns that realize two or more resonant modes with mutually different polarization directions, the conductor pattern of each resonator does not have to be elliptical, either. For example, a partially notched disklike conductor pattern may be used, too. The point is that the respective resonators are preferably coupled together in one of at least two fundamental resonant modes with mutually different frequencies and that an attenuation pole is preferably created at a frequency corresponding to another fundamental resonant mode. However, the frequency for the attenuation pole can be controlled more precisely by using the elliptical conductors rather than by using the notched disklike conductors.

In the preferred embodiment described above, the first and fourth resonators 21 and 24 are formed in an elliptical shape so as to satisfy the inequality $d_1>d_2$. Alternatively, the resonators 21 and 24 may also be shaped so as to satisfy $d_1<d_2$ to the contrary. In that case, $d_1$ is preferably defined so as to make the dipole mode in the minor-axis direction of the ellipse produce resonance at a desired frequency and $d_2$ is preferably defined so as to make the dipole mode in the major-axis direction produce resonance at a sufficiently different frequency. Also, the respective axial lengths may be matched together such that the dipole mode in the minor-axis direction of a resonator couples with the dipole mode in the major-axis direction of its adjacent resonator.

Furthermore, since the dipole modes in the minor-axis direction are used in the second and third resonators 22 and 23, the attenuation pole is created in a frequency range that exceeds the pass band (in the vicinity of the resonant frequency) as shown in FIG. 2. If the attenuation pole should be created at a frequency that falls short of the pass band, then $d_3$ is preferably defined so as to adjust the dipole mode in the minor-axis direction to the pass band, $d_4$ is preferably defined so as to adjust the dipole mode in the major-axis direction to the frequency for the attenuation pole and $d_3<d_4$ is preferably satisfied. Also, even if the attenuation poles should be created on both sides of the pass band, this object is achieved easily by combining these techniques.

Figure 5:
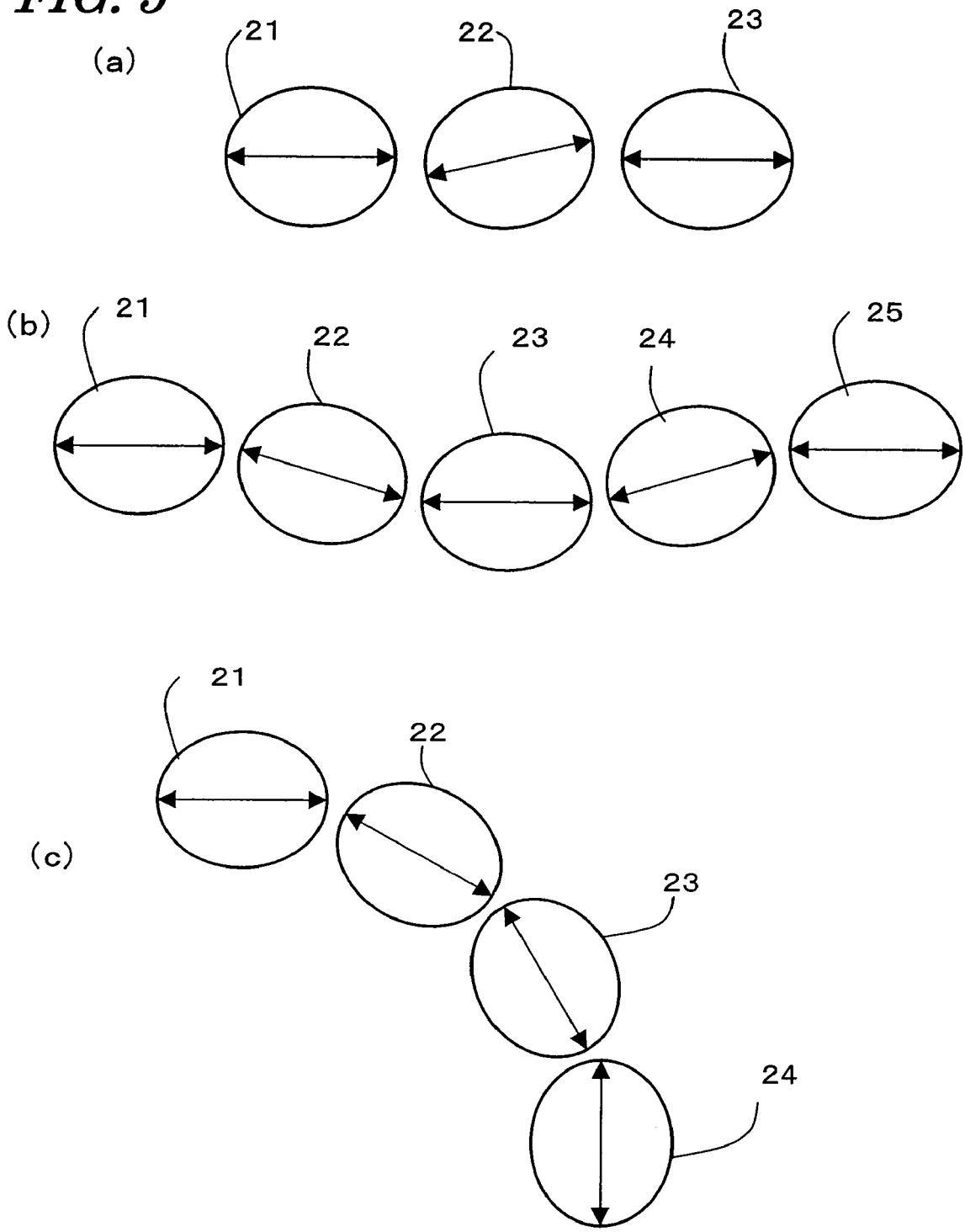
FIGS. 5(*a*), 5(*b*) and 5(*c*) are plan views showing various arrangements of resonators in RF circuit components according to the present invention.

FIGS. 5(*a*) through 5(*c*) are plan views showing alternative arrangements of resonators according to this preferred embodiment. In the example illustrated in FIG. 5(*a*), a three-stage resonator arrangement, including first, second and third resonators 21, 22 and 23, is defined. The elliptical major-axis direction of the first resonator 21 is parallel to that of the third resonator 23 but the elliptical major-axis direction of the second resonator 22 defines an angle exceeding zero degrees with respect to that of the other resonators.

In the example illustrated in FIG. 5(*b*), a five-stage resonator arrangement, including first through fifth resonators 21, 22, 23, 24 and 25, is defined. In this example, the first, third and fifth resonators 21, 23 and 25 have elliptical conductor patterns, of which the major axes face the same direction, while the second and fourth resonators 22 and 24 have elliptical conductor patterns, of which the major axes have rotated in mutually opposite directions.

In the example illustrated in FIG. 5(*c*), first through fourth resonators 21, 22, 23 and 24 have elliptical conductor patterns, of which the major axes rotate gradually.

As described above, according to this preferred embodiment, the arrangements of respective resonators are combined, thereby achieving the target filter characteristic in various layouts and increasing the freedom of design significantly.

In the RF circuit component shown in FIG. 1, every resonator has an elliptical conductor pattern. Alternatively, some of the resonators may have a disklike conductor pattern or a conductor pattern of any other shape. It should be noted that if all of those resonators are formed as disklike conductor patterns, then two resonant modes, polarized in two perpendicular directions, need to be induced by providing notched conductor patterns for at least one of the resonators, for example.

The conductor pattern of each resonator preferably has a smooth profile but may have an angular profile as well.

EMBODIMENT 2

Figure 6:
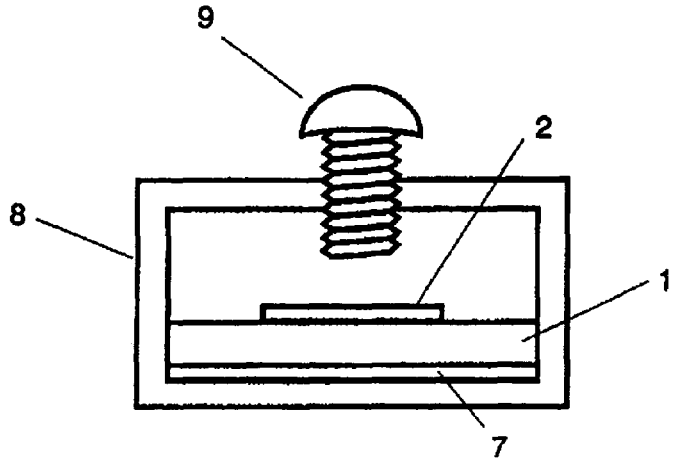
FIG. 6 is a cross-sectional view of an RF circuit component according to a second preferred embodiment of the present invention.
Figure 7:
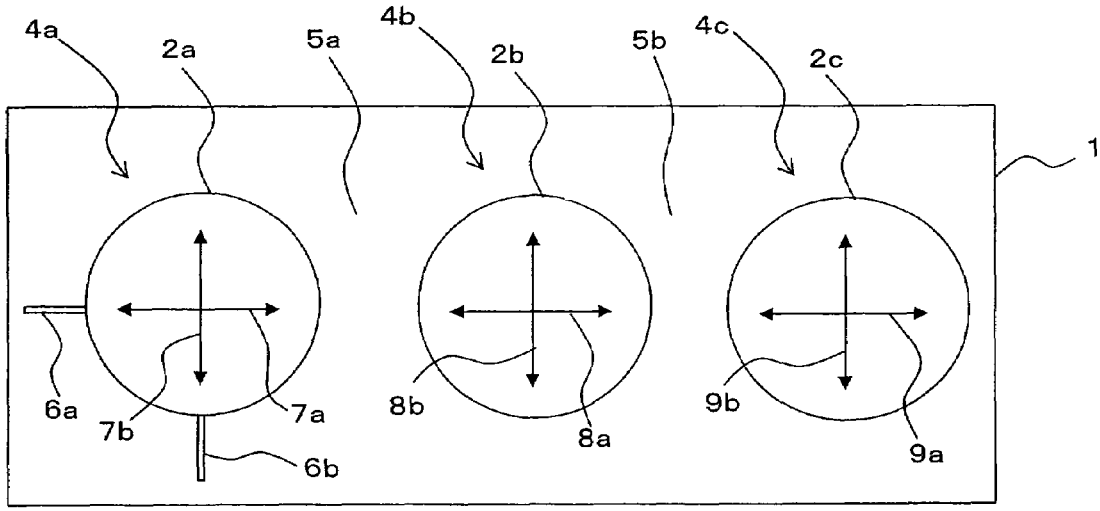
FIG. 7 PRIOR ART
FIG. 7 is a plan view illustrating a conventional RF circuit component.

Hereinafter, an RF circuit component according to a second preferred embodiment of the present invention will be described with reference to FIG. 6, which is a transversal cross-sectional view of the RF circuit component of this preferred embodiment.

The substrate 1 and resonators 21, 22, 23 and 24 of this preferred embodiment have the same structures as the counterparts of the first preferred embodiment described above. However, unlike the first preferred embodiment, the RF circuit component of this preferred embodiment further includes a metallic housing 8 that surrounds the substrate 1.

A portion of the metallic housing 8 of this preferred embodiment, which is located over the upper surface of the substrate 1 (i.e., the side that the resonator 2 faces), includes a metallic screw 9 that extends through the metallic housing 8.

The electromagnetic field, created by the two dipole modes resonating in the resonator 21, 22, 23 or 24, partially leaks out of the resonator 21, 22, 23 or 24 upward. In this preferred embodiment, the resonant frequencies of the dipole modes are finely adjusted by utilizing such a leaking magnetic field. More specifically, the screw 9 is provided in the region where the leaking magnetic field is present and the top of that screw 9 is controlled, thereby finely adjusting the resonant frequencies of the dipole modes.

By adopting such a configuration, the circuit patterning precision can be relaxed and the yield at the manufacturing stage can be increased effectively.

Also, by surrounding the entire substrate 1 with the metallic housing 8, the electromagnetic waves, radiated from the resonators 21, 22, 23 and 24, can be cut off. As a result, the loss of the circuit can be reduced and the interference with another circuit can be avoided as well.

In this preferred embodiment, the metallic screw 9 is used. However, the screw 9 does not have to be a metallic screw. Alternatively, a screw made of a dielectric material or a metallic or dielectric bar may be provided over the resonators. Even so, the resonant frequencies can also be adjusted as effectively as the preferred embodiment just described. Optionally, the screws 9 may be provided in the respective gaps 61 and 62 between the two resonators such that the degree of coupling between the resonators can be adjusted.

Alternative Embodiments

It is even more effective to use a superconductor as the material of the conductor patterns functioning as the resonators of the present invention. Generally speaking, if a superconductor is used as the conductor material of a resonator, then the conductor loss becomes very small and the Q value of the resonator can be increased by leaps and bounds. However, in using a superconductor, when the maximum current density in the conductor exceeds a critical current density value, which is defined with respect to the radio frequency current of the superconductor material, the superconducting property is destroyed and the conductor cannot function as a resonator anymore. Nevertheless, the resonator of the present invention can have a decreased maximum current density as described above. Accordingly, by making the conductor of a superconductor, an RF signal with higher power can be processed as compared with a resonator with a conventional structure. As a result, a resonator that exhibits a high Q value even in response to an RF signal with high power is realized. Thus, significant effects are achieved.

In the preferred embodiments described above, the substrate is made of a glass ceramic material (with a relative dielectric constant of 5.6 and an fQ value of 33,000) including an $Al_2O_3$—MgO—$Gd_2O_3$—$SiO_2$ based ceramic filler and $SiO_2$—$Al_2O_3$—$B_2O_3$—MgO—ZnO based glass. However, the substrate materials that can be used effectively in the present invention are never limited to such materials. Alternatively, any other general dielectric material such as single crystalline dielectric materials and resin materials may be used, too. Nevertheless, to realize the low-loss and steep filter characteristic, a material with small dielectric loss needs to be used. Also, to decrease the size, a material with a high relative dielectric constant is preferably used.

The glass ceramic material including an $Al_2O_3$—MgO—$Gd_2O_3$—$SiO_2$ based ceramic filler and $SiO_2$—$Al_2O_3$—$B_2O_3$—MgO—ZnO based glass for use in the preferred embodiments described above is a material that has a relatively low dielectric constant and very small dielectric loss. Thus, this material can be used particularly effectively in milliwave or sub-milliwave band applications in which not so much small size as low loss is demanded strongly.

As can be seen easily, a material with a relative dielectric constant of less than 10 is particularly effective in a radio frequency range of 10 GHz or more. Conversely, in a frequency range of less than 10 GHz in which the downsizing demand is more dominating, a material with a relative dielectric constant of 10 or more such as Ba(Mg, Ta)$O_3$-based ceramic material is preferred. Furthermore, the conductor material does not have to be silver or a superconductor as in the preferred embodiment described above. Alternatively, gold, copper, aluminum or any other suitable metal may be used almost as effectively although the resultant loss is different to a certain extent.

INDUSTRIAL APPLICABILITY

According to the present invention, an RF circuit component, which exhibits a steep filter characteristic by forming an attenuation pole with high precision, can be provided easily using planar resonators.

The invention claimed is:

1. An RF circuit component comprising:

a substrate with a principal surface; and a plurality of resonators, including a first resonator, a second resonator and a third resonator, which are arranged on the principal surface of the substrate so as to be coupled in series together, wherein each of the first, second and third resonators is made of a conductor supported on the substrate, and wherein the resonant modes of each of the first, second and third resonators include two fundamental resonant modes that are polarized perpendicularly to each other within a plane that is defined parallel to the principal surface of the substrate, said fundamental resonant modes having two mutually different resonant frequencies, and wherein the second resonator is arranged between the first and third resonators, and the polarization direction of one of the fundamental resonant modes of the second resonator defines an angle greater than 0 degrees but equal to or smaller than 45 degrees with respect to that of its associated fundamental resonant mode of one of the first resonator and the third resonator, wherein the first, second and third resonators are coupled by said one of the fundamental resonant modes.

2. The RF circuit component of claim 1, wherein the second resonator is made of a conductor, which has an elliptical cross section when taken parallel to the principal surface, and wherein the polarization directions of the two fundamental resonant modes of the second resonator are respectively parallel to the major axis and minor axis of the elliptical cross section.

3. The RF circuit component of claim 1, wherein each of the first and third resonators is made of a conductor, which has an elliptical cross section when taken parallel to the principal surface, and wherein the polarization directions of the two fundamental resonant modes in each of the first and third resonators are respectively parallel to the major axis and minor axis of the elliptical cross section.

4. The RF circuit component of claim 1, further comprising an input coupling terminal for inputting an RF signal to one of the resonators and an output coupling terminal for outputting the RF signal from another one of the resonators.

5. The RF circuit component of claim 1, wherein each of the two resonators coupled to the input and output coupling terminals, respectively, is made of a conductor, which has the shape of an ellipse when taken parallel to the principal surface, and wherein the input coupling terminal is coupled to the resonator at a point away from an intersection between the major or minor axis of the ellipse and the ellipse itself, and the output coupling terminal is coupled to the resonator at a point away from an intersection between the major or minor axis of the ellipse and the ellipse itself.

6. The RF circuit component of claim 1, wherein the first resonator and the input coupling terminal are directly connected together and the third resonator and the output coupling terminal are directly connected together.

7. The RF circuit component of claim 1, further comprising a metallic housing that is arranged so as to surround the substrate, wherein a screw is provided so as to go through the metallic housing.

8. The RF circuit component of claim 1, wherein the conductor is made of a superconductor material.

* * * * *